US010020560B1

(12) United States Patent
Chou et al.

(10) Patent No.: US 10,020,560 B1
(45) Date of Patent: Jul. 10, 2018

(54) STACKED CIRCULARLY POLARIZED ANTENNA STRUCTURE

(71) Applicant: Cirocomm Technology Corp., Tainan (TW)

(72) Inventors: Shin-Hui Chou, Tainan (TW); Chia-Tsung Wu, Tainan (TW); Chien-Hua Tseng, Tainan (TW); Feng-Chou Tien, Tainan (TW)

(73) Assignee: CIROCOMM TECHNOLOGY CORP., Tainan (TW)

( * ) Notice: Subject to any disclaimer, the term of this patent is extended or adjusted under 35 U.S.C. 154(b) by 61 days.

(21) Appl. No.: 15/401,060

(22) Filed: Jan. 8, 2017

(51) Int. Cl.
*H01Q 9/04* (2006.01)
*H01Q 1/24* (2006.01)
*H01Q 1/48* (2006.01)

(52) U.S. Cl.
CPC ..... *H01Q 1/24* (2013.01); *H01Q 1/48* (2013.01); *H01Q 9/0414* (2013.01); *H01Q 9/0428* (2013.01)

(58) Field of Classification Search
CPC ..... H01Q 1/24; H01Q 1/48; H01Q 9/0428; H01Q 9/0414
See application file for complete search history.

(56) References Cited

U.S. PATENT DOCUMENTS 4,218,682 A * 8/1980 Frosch ..... H01Q 9/0414 343/700 MS
2010/0073236 A1* 3/2010 Mierke ..... H01Q 9/0414 343/700 MS

* cited by examiner

*Primary Examiner* — Dameon E Levi
*Assistant Examiner* — David Lotter
(74) *Attorney, Agent, or Firm* — Chun-Ming Shih; HDLS IPR Services

(57) ABSTRACT

The invention relates to a stacked circularly polarized antenna structure (10). The stacked circularly polarized antenna structure (10) comprises a first antenna (1), a second antenna (2), and an adhesive element (3). The adhesive element (3) is adhered between the first antenna (1) and the second antenna (2) to stack and form a stacked circularly polarized antenna structure (10) having the first antenna (1) and the second antenna (2) made of ceramic material with the same dielectric constant, having two feeding elements to reach circular polarization and enhance antenna bandwidth, and stacking the two antennas (1, 2) together to form two resonance frequencies.

14 Claims, 8 Drawing Sheets

STACKED CIRCULARLY POLARIZED ANTENNA STRUCTURE

BACKGROUND OF THE INVENTION

Field of the Invention

The invention relates to an antenna, and particularly to a stacked circularly polarized antenna structure used in a global positioning system (GPS).

Description of the Related Art

In recent years, GPS has widely been used in many electronic communication products. People use the GPS system for navigation while driving cars, walking outdoor, or taking exercise. Currently, the automobile or electronic communication products have GPS navigation system as standard equipment supplied or available for download, in order to attract people's desire for consumption. In use of the GPS navigation system, a positioning radio wave is emitted synchronously by satellite, and after the positioning radio wave is received by the user's GPS navigation system, the distance between the GPS navigation system and the satellite can be calculated based on time difference, and motion data of these satellite existing in the GPS navigation system itself are enough to set the user's location.

At present, the GPS navigation system has two emitting frequencies. The present GPS navigation system may transmit a C/A code having a length of 1023 bits and a message of navigation information of 50 bits per second, and therefrom time may be decided in a signal of L1 channel of 1575.42 MHz. The L1 channel also includes a P/Y military signal. The present GPS satellite also may transmit the P/Y military signal in a signal of L2 channel of 1227.6 MHz.

Therefore, the conventional navigation system uses two base bodies having different materials for example, different dielectric constant to manufacture a stacked circularly polarized antenna for receiving the two frequencies. The stacked circularly polarized antenna can receive frequency of 1575.42 MHz and frequency of 1227.6 MHz, as feeding a single signal. Because two materials having different dielectric constants are used, the dielectric constant is not easy to adjust, and thus it is difficult to manufacture a circularly polarized antenna having a desired dielectric constant.

SUMMARY OF THE INVENTION

One object of the present invention is to provide a stacked circularly polarized antenna structure having two antennas made of ceramic material with the same dielectric constant, having two feeding elements to reach circular polarization and enhance antenna bandwidth, and stacking the two antennas together to form two resonance frequencies.

In order to achieve the above-described object, the present invention provides a stacked circularly polarized antenna structure comprising a first antenna, a second antenna and an adhesive element. The first antenna includes a first base body, a first electrode layer, a first grounding layer and at least one first feeding element, wherein the first base body has a first front surface, a first rear surface and at least two through holes penetrated through the first base body; the first electrode layer is provided on the first front surface, and the first grounding layer is provided on the first rear surface; and the first feeding element goes through one of the through holes and electrically connects to the first electrode layer, and the first feeding element extends to outside of the first rear surface with its end, and not to electrically connect the first grounding layer. The second antenna includes a second base body, a second electrode layer and at least one second feeding element, wherein the second base body has a second front surface, a second rear surface and at least one perforation penetrated through the second base body; the second electrode layer is provided on the second front surface; the second feeding element goes through the perforation and another one through hole so that the second feeding element electrically connects to the second electrode layer, and the second feeding element extends to outside of the first rear surface with its end, and not to electrically connect the first grounding layer. The adhesive element is provided between the first antenna and the second antenna, the adhesive element preventing the first feeding element from contacting with the second rear surface of the second base body, and the adhesive element having an opening thereon, and through which the second feeding element goes through the perforation and the another one through hole.

In an aspect of the invention, the first base body and the second base body are square base bodies made of ceramic material, have the same dielectric constant and thickness, and the second base body has the second rear surface with an area smaller than an area of the first electrode layer.

In an aspect of the invention, the first feeding element is a nail with T shape sectional view, and has a head and a rod body extended from the bottom of head, the rod body of the first feeding element goes through the through hole so that the head electrically connects to the first electrode layer; and the second feeding element is a nail with T shape sectional view, and has a head and a rod body extended from the bottom of head, the rod body of the second feeding element goes through the perforation and the through hole so that the head electrically connects to the second electrode layer.

In an aspect of the invention, the adhesive element is a double-sided adhesive.

In an aspect of the invention, the through holes include a first through hole, a second through hole, a third through hole and a fourth through hole.

In an aspect of the invention, the second rear surface of the second base body is provided with a second grounding layer, and the second grounding layer fails to connect electrically to the second feeding element and fails to contact the first feeding element.

In an aspect of the invention, the first antenna has two first feeding elements, in which the two feeding elements respectively go through the first through hole and the second through hole to electrically connect to the first electrode layer, the two first feeding elements extend to outside of the first rear surface of the first base body with their ends, and not to electrically connect the first grounding layer.

In an aspect of the invention, perforations on the second base body include a first perforation and a second perforation.

In an aspect of the invention, the second antenna has two second feeding elements, in which the two second feeding elements respectively go through the first perforation and the second perforation to electrically connect to the second electrode layer, and the two second feeding elements respectively go through the third through hole and the fourth through hole of the first base body, the two second feeding elements extend to outside of the first rear surface of the first base body with their ends, and not to electrically connect the first grounding layer.

In an aspect of the invention, the two first feeding elements are nails with T shape sectional view, and each has a head and a rod body extended from the bottom of the head, the two rod bodies of the two first feeding elements go through the first through hole and the second through hole so that the two heads of the two first feeding elements electrically connect to the first electrode layer; and the two second feeding elements are nails with T shape sectional view, and each has a head and a rod body extended from the bottom of the head, the two rod bodies of the two second feeding elements go through the first perforation and the second perforation so that the two heads of the two second feeding elements electrically connect to the second electrode layer.

In an aspect of the invention, the second rear surface of the second base body is provided with a second grounding layer, and the second grounding layer fails to connect electrically to the two second feeding elements and fails to contact electrically the two first feeding elements.

DESCRIPTION OF THE EMBODIMENTS

The features of the invention believed to be novel are set forth with particularity in the appended claims. The invention itself, however, may be best understood by reference to the following detailed description of the invention, which describes exemplary embodiments of the invention, taken in conjunction with the accompanying drawings.

Figure 1:
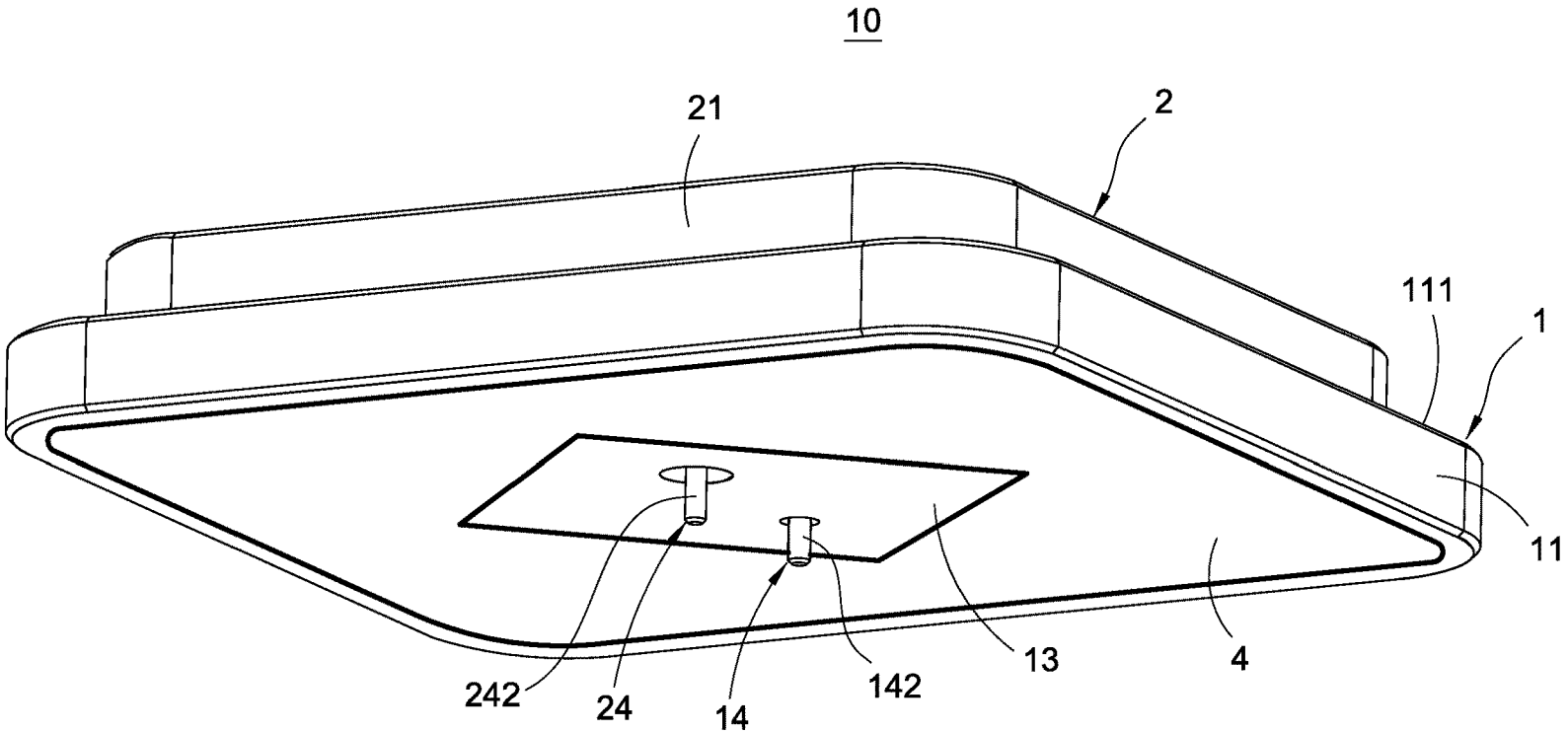
FIG. 1 shows an elevational view of a stacked circularly polarized antenna structure of a first embodiment of the invention.
Figure 2:
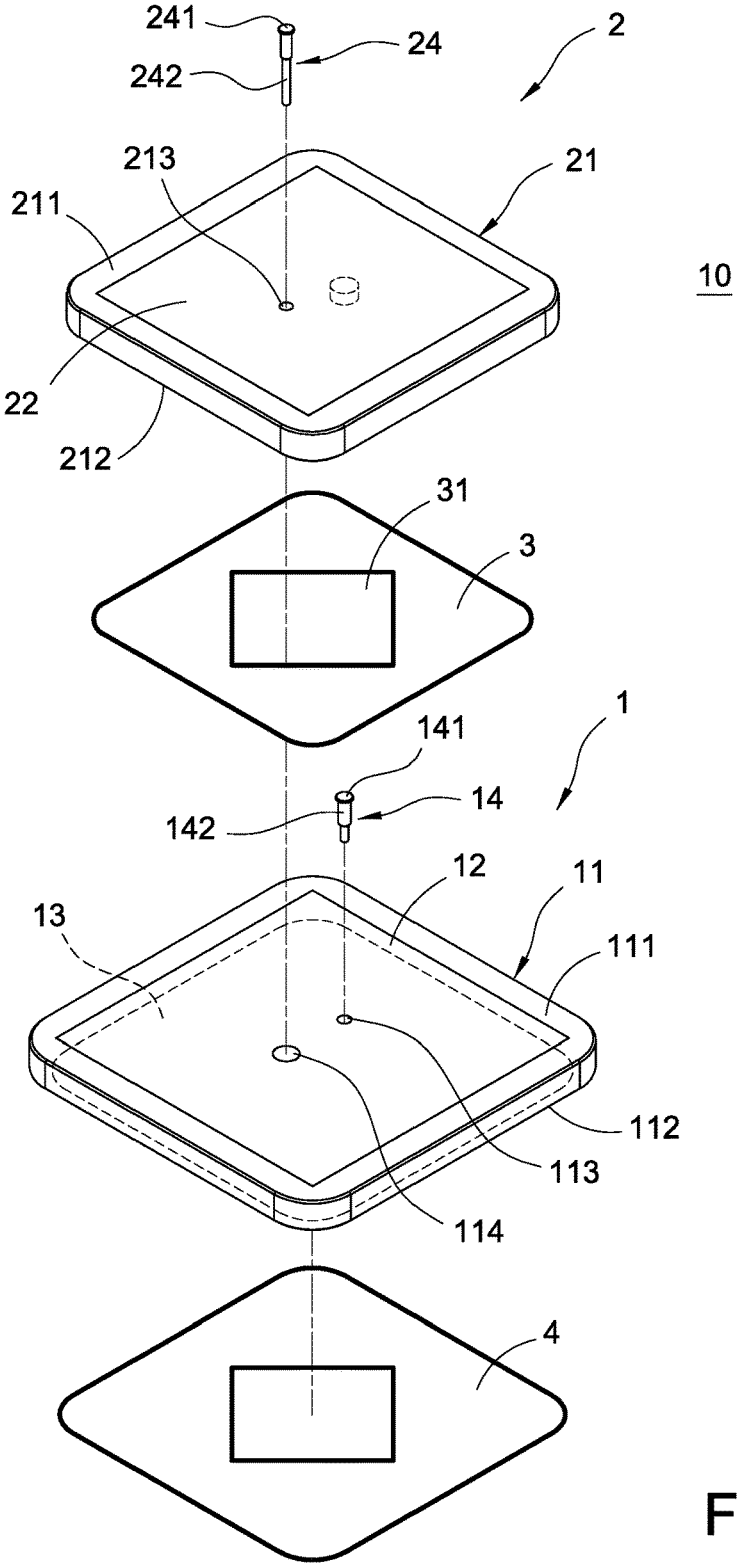
FIG. 2 shows an exploded view of a stacked circularly polarized antenna structure of a first embodiment of the invention.

FIG. 1 shows an elevational view of a stacked circularly polarized antenna structure of a first embodiment of the invention. FIG. 2 shows an exploded view of a stacked circularly polarized antenna structure of a first embodiment of the invention. Please refer to FIGS. 1 and 2. The stacked circularly polarized antenna structure 10 of the invention comprises a first antenna 1, a second antenna 2 and two adhesive elements 3, 4, wherein the second antenna 2 is adhered on the first antenna 1 by the adhesive element 3 to stack and form a stacked circularly polarized antenna structure 10.

The first antenna 1 includes a first base body 11, a first electrode layer 12, a first grounding layer 13 and a first feeding element 14. The first base body 11 is a square base body made of ceramic material, and has a first front surface 111, a first rear surface 112 and at least two through holes penetrated through the first base body 11. Herein, two through holes are a first through hole 113 and a third through hole 114. The first electrode layer 12 is provided on the first front surface 111, and the first grounding layer 13 is provided on the first rear surface 112. The first feeding element 14 is a nail with T shape sectional view, and has a head 141 and a rod body 142 extended from the bottom of head 141. The rod body 142 goes through the first through hole 113 so that the head 141 can electrically connect to the first electrode layer 12, and the rod body 142 which goes through the first through hole 113 with its end not to electrically connect the first grounding layer 13, but connect electrically to an external circuit board (not shown in the drawing). The first antenna 1 may couple with the first grounding layer 13 by the first electrode layer 12 to have resonance of the first band.

The second antenna 2 includes a second base body 21, a second electrode layer 22 and a second feeding element 24. The second base body 21 is also a square base body made of ceramic material, and has the same dielectric constant and thickness to the first base body 11. The second base body 21 has a second front surface 211, a second rear surface 212 and at least one perforation penetrated through the second base body 21. Herein, the perforation is a first perforation 213. The second base body 21 has the second rear surface 212 with an area smaller than the area of the first electrode layer 12. The second electrode layer 22 is provided on the second front surface 211. In addition, the second feeding element 24 is a nail with T shape sectional view, and has a head 241 and a rod body 242 extended from the bottom of head 241. The rod body 242 of the second feeding element 24 goes through the first perforation 213 so that the head 241 can electrically connect to the second electrode layer 22. Because the rod body 242 of the second feeding element 24 is longer than the rod body 142 of the first feeding element 14, the rod body 242 goes through the first perforation 213 while the rod body 242 goes through the third through hole 114 and extends to the outside of the first rear surface 112 of the first base body 11. The rod body 242 fails to connect electrically the first grounding layer 13, but connect electrically to an external circuit board (not shown in the drawing). The second antenna 2 may couple with the first grounding layer 13 by the second electrode layer 22 to have resonance of the second band.

The adhesive element 3 is provided between the first antenna 1 and the second antenna 2, and the adhesive element 4 is provided on the bottom of the first grounding layer 13 of the first antenna 1. The second antenna 2 is adhered to the top of the first antenna 1 by the adhesive element 3 to form a stack to prevent the head 141 of the first feeding element 14 from contacting with the second rear surface 212 of the second antenna 2. Also, the adhesive element 3 has an opening 31 thereon, and through which the rod body 242 of the second feeding element 24 goes through the third through hole 114 and extends the outside of the first rear surface 112 of the first base body 11. In FIG. 2, the adhesive elements 3, 4 are double-sided adhesive.

Figure 3:
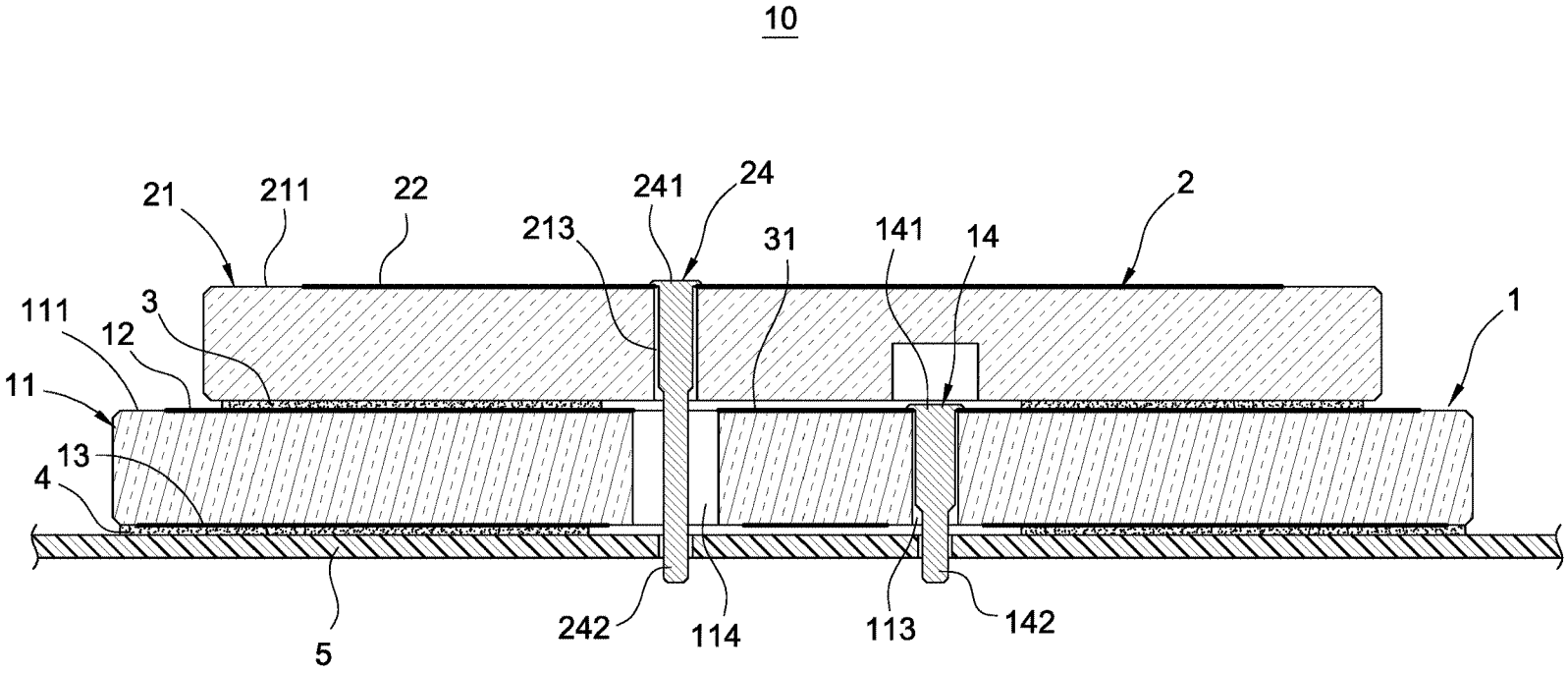
FIG. 3 shows a sectional view of a stacked circularly polarized antenna structure of a first embodiment of the invention electrically connecting with a circuit board.

FIG. 3 shows a sectional view of a stacked circularly polarized antenna structure of a first embodiment of the invention electrically connecting with a circuit board. As shown in the FIG. 3, a stacked circularly polarized antenna structure 10 of the invention is formed by the adhesive element 3 to adhere the first antenna 1 and the second antenna 2. Another adhesive element 4 is adhered on the first grounding layer 13 of the first antenna 1 so that the stacked circularly polarized antenna structure 10 can be adhered on the circuit board 5. Also, the circuit board 5 electrically connects two cable connectors 51, 52 that may electrically connect to the first feeding element 14 of the first antenna 1 and the second feeding element 24 of the second antenna 2 respectively.

Figure 4:
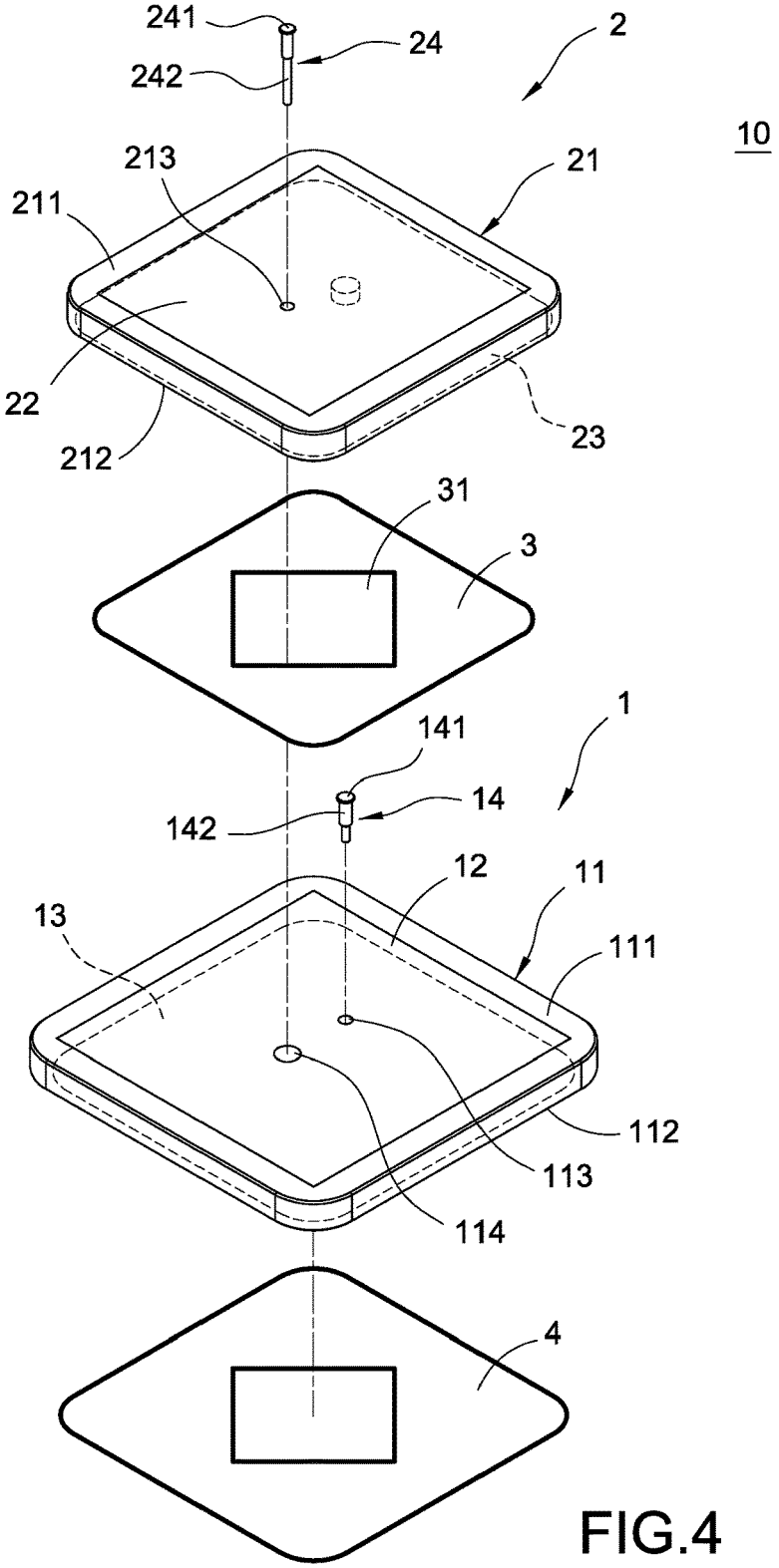
FIG. 4 shows an exploded view of a stacked circularly polarized antenna structure of a second embodiment of the invention.

FIG. 4 shows an exploded view of a stacked circularly polarized antenna structure of a second embodiment of the invention. As shown in the FIG. 4, a stacked circularly polarized antenna structure 10 of the second embodiment is similar to that of the first embodiment. The difference is that a second grounding layer 23 is provided on the second rear surface 212 of the second antenna 2. As the rod body 242 of the second feeding element 24 goes through the first perforation 213 not to connect electrically to the second grounding layer 23. The second electrode layer 22 may couple with the second grounding layer 23 to have resonance of the second band.

Figure 5:
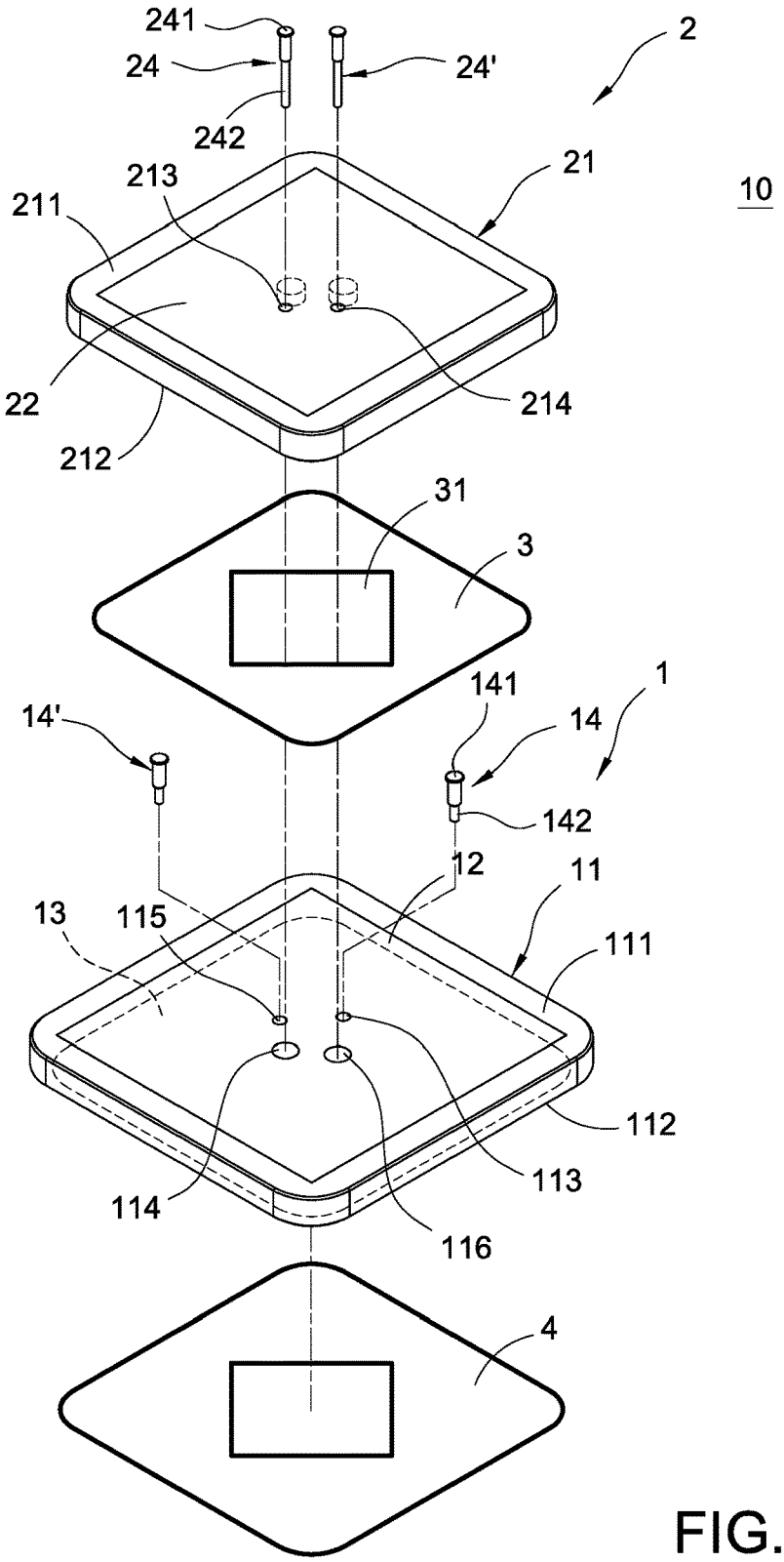
FIG. 5 shows an exploded view of a stacked circularly polarized antenna structure of a third embodiment of the invention.

FIG. 5 shows an exploded view of a stacked circularly polarized antenna structure of a third embodiment of the invention. As shown in the FIG. 5, a stacked circularly polarized antenna structure 10 of the third embodiment is similar to that of the first embodiment. The difference is that the first antenna 1 has two first feeding elements 14, 14' and the second antenna 2 has two second feeding elements 24, 24'. Also, the first base body 11 further has a second through hole 115 and a fourth through hole 116. The first feeding element 14 goes through the first through hole 113 and the first feeding element 14' goes through the second through hole 115. Also, the second base body 21 further has a second perforation 214. The second feeding element 24 goes through the first perforation 213 and the third through hole 114, and the second feeding element 24' goes through the second perforation 214 and the fourth through hole 116, and the adhesive element 3 is used to adhere the first antenna 1 and the second antenna 2 to form a stacked circularly polarized antenna structure 10. In the embodiment, the second antenna 2 is provided on the first antenna 1 to stack and form a stacked circularly polarized antenna structure 10, and the first antenna 1 and the second antenna 2 can enhance the band of the antenna by two first feeding elements 14, 14' and two second feeding elements 24, 24'.

Figure 6:
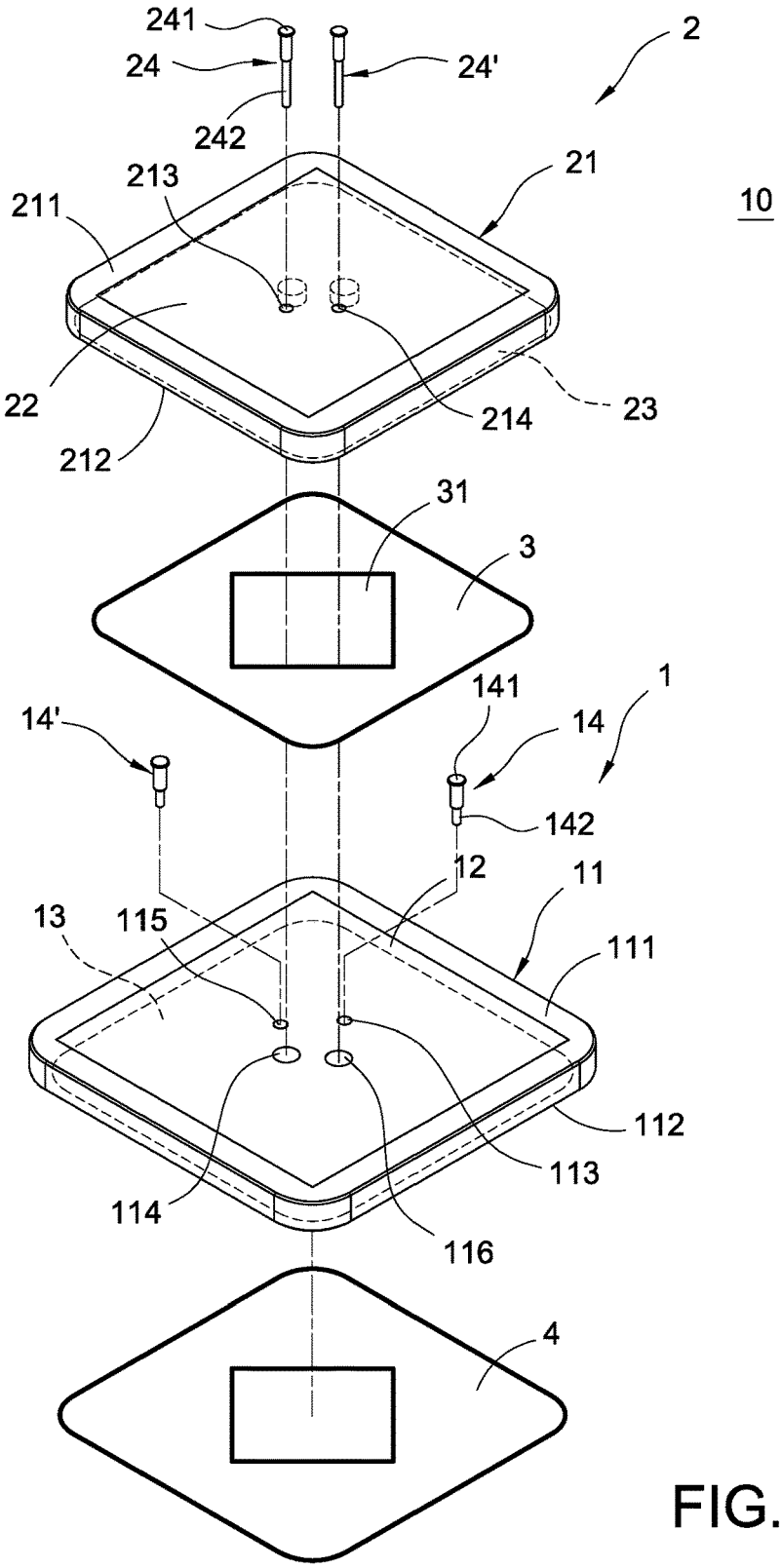
FIG. 6 shows an exploded view of a stacked circularly polarized antenna structure of a fourth embodiment of the invention.

FIG. 6 shows an exploded view of a stacked circularly polarized antenna structure of a fourth embodiment of the invention. As shown in the FIG. 6, a stacked circularly polarized antenna structure 10 of the fourth embodiment is similar to that of the third embodiment. The difference is that a second grounding layer 23 is provided on the second rear surface 212 of the second antenna 2. As the rod body 242 of the second feeding element 24 goes through the first perforation 213 not to connect electrically the second grounding layer 23. The second electrode layer 22 may couple with the second grounding layer 23 to have resonance of the second band.

Figure 7:
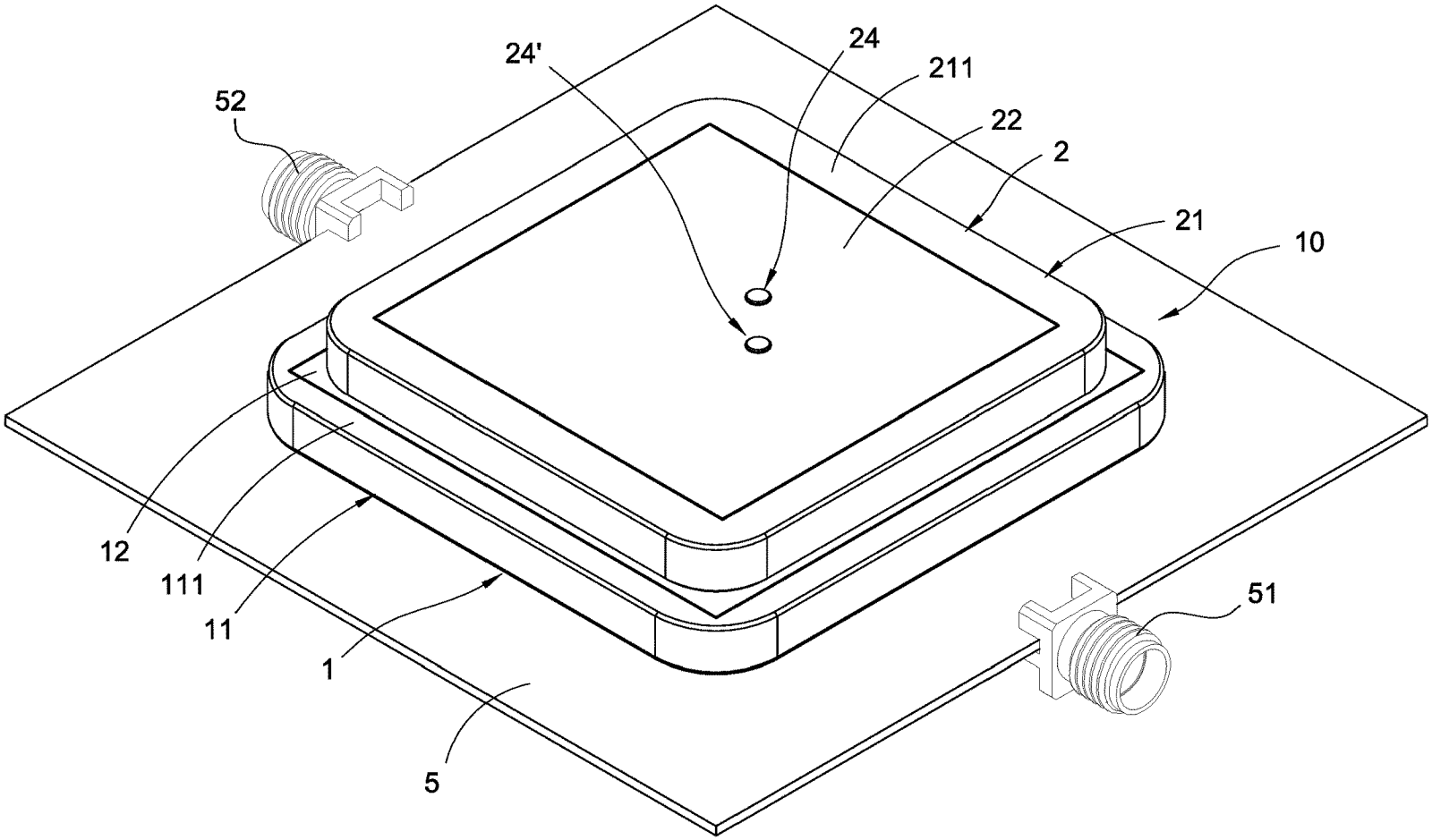
FIG. 7 shows an operation state of a stacked circularly polarized antenna structure of a fourth embodiment of the invention.
Figure 8:
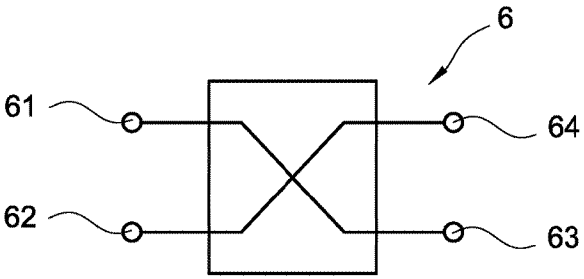
FIG. 8 shows a wiring of an integrated circuit of a stacked circularly polarized antenna structure of a fourth embodiment of the invention.
Figure 9:
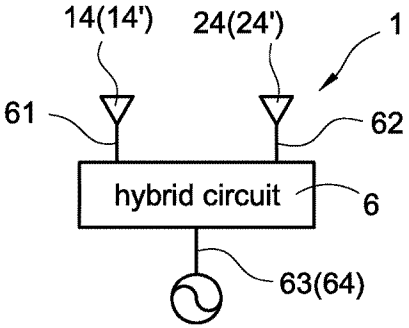
FIG. 9 shows a schematic block diagram of a stacked circularly polarized antenna structure of a fourth embodiment of the invention.

FIG. 7 shows an operation state of a stacked circularly polarized antenna structure of a fourth embodiment of the invention. FIG. 8 shows a wiring of an integrated circuit of a stacked circularly polarized antenna structure of a fourth embodiment of the invention. FIG. 9 shows a schematic block diagram of a stacked circularly polarized antenna structure of a fourth embodiment of the invention. The fourth embodiment of the invention is illustrated to understand the effect of the invention. In a stacked circularly polarized antenna structure 10 formed by the first antenna 1 and the second antenna 2 of the invention, the adhesive element 4 is adhered on the first grounding layer 13 of the first antenna 1 so that the stacked circularly polarized antenna structure 10 can be adhered on the circuit board 5. Also, two first feeding elements 14, 14' may electrically connect to a first pin 61 of a hybrid circuit 6 on the circuit board 5 to form a first band (1575.42 $MH_Z$) used in GPS, and two second feeding elements 24, 24' may electrically connect to a second pin 62 of a hybrid circuit 6 on the circuit board 5 to form a second band (1227.6 $MH_Z$) used in GPS. In a different demand, the two signal sources (a first band and a second band) of a third pin 63 and a four pin 64 of the hybrid circuit 6 can be integrated into an output of a signal source, and an output of the third pin 63 or the four pin 64 can be selected to control left polarization or right polarization of the stacked circularly polarized antenna structure 10, and the residual one has to be connected to an impedance matching below 50 ohm.

Figure 10:
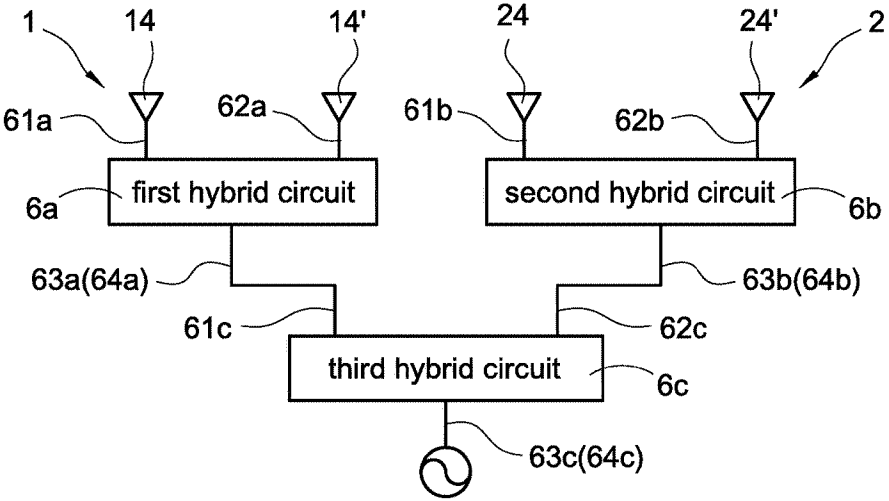
FIG. 10 shows another operation state of a stacked circularly polarized antenna structure of a fourth embodiment of the invention.

FIG. 10 shows another operation state of a stacked circularly polarized antenna structure of a fourth embodiment of the invention. As shown in FIG. 10, in a stacked circularly polarized antenna structure 10 formed by the first antenna 1 and the second antenna 2 of the invention, two first feeding elements 14, 14' may respectively electrically connect to a first pin 61*a* and a second pin 62*a* of a first hybrid circuit 6*a* to form a first band (1575.42 $MH_Z$) used in GPS, and two second feeding elements 24, 24' may respectively electrically connect to a first pin 61*b* and a second pin 62*b* of a second hybrid circuit 6*b* to form a second band (1227.6 $MH_Z$) used in GPS. The two signal sources of a third pin 63*a* (or a fourth pin 64*a*) of the first hybrid circuit 6*a* and a third pin 63*b* (or a fourth pin 64*b*) of the second hybrid circuit 6*b* respectively input a first pin 61*c* and a second pin 62*c* of the third hybrid circuit 6*c*, and then two signal sources of a third pin 63*c* and a fourth pin 64*c* of the third hybrid circuit 6*c* can be integrated into an output of a signal source, and an output of the third pin 63*c* or the four pin 64*c* can be selected.

As the skilled person will appreciate, various changes and modifications can be made to the described embodiments. It is intended to include all such variations, modifications and equivalents which fall within the scope of the invention, as defined in the accompanying claims.

What is claimed is:

1. A stacked circularly polarized antenna structure (10) comprising:

a first antenna (1) including a first base body (11), a first electrode layer (12), a first grounding layer (13) and at least one first feeding element (14), wherein the first base body (11) has a first front surface (111), a first rear surface (112) and at least two through holes penetrated through the first base body (11); the first electrode layer (12) is provided on the first front surface (111), and the first grounding layer (13) is provided on the first rear surface (112); and the first feeding element (14) goes through one of the through holes and electrically connects to the first electrode layer (12), and the first feeding element (14) extends to outside of the first rear surface (112) with its end, and not to electrically connect the first grounding layer (13);

a second antenna (2) including a second base body (21), a second electrode layer (22) and at least one second feeding element (24), wherein the second base body (21) has a second front surface (211), a second rear surface (212) and at least one perforation penetrated through the second base body (21); the second electrode layer (22) is provided on the second front surface (211); the second feeding element (24) goes through the perforation and another one through hole so that the second feeding element (24) electrically connects to the second electrode layer (22), and the second feeding element (24) extends to outside of the first rear surface (112) with its end, and not to electrically connect the first grounding layer (13);

an adhesive element (3) provided between the first antenna (1) and the second antenna (2), the adhesive element (3) preventing the first feeding element (14) from contacting with the second rear surface (212) of the second base body (21), and the adhesive element (3) having an opening (31) thereon, and through which the second feeding element (24) goes through the perforation and the another one through hole.

2. The stacked circularly polarized antenna structure of claim 1, wherein the first base body (11) and the second base body (21) are square base bodies made of ceramic material, have the same dielectric constant and thickness, and the second base body (21) has the second rear surface (212) with an area smaller than an area of the first electrode layer (12).

3. The stacked circularly polarized antenna structure of claim 2, wherein the first feeding element (14) is a nail with T shape sectional view, and has a head (141) and a rod body (142) extended from the bottom of head (141), the rod body (142) of the first feeding element (14) goes through the through hole so that the head (141) electrically connects to the first electrode layer (12); and the second feeding element (24) is a nail with T shape sectional view, and has a head (241) and a rod body (242) extended from the bottom of head (241), the rod body (242) of the second feeding element (24) goes through the perforation and the through hole so that the head (241) electrically connects to the second electrode layer (22).

4. The stacked circularly polarized antenna structure of claim 3, wherein the adhesive element (3) is a double-sided adhesive.

5. The stacked circularly polarized antenna structure of claim 4, wherein the through hole is a first through hole (113) and a third through hole (114).

6. The stacked circularly polarized antenna structure of claim 3, wherein the second rear surface (212) of the second base body (21) is provided with a second grounding layer (23), and the second grounding layer (23) fails to connect electrically to the second feeding element (24) and fails to contact the first feeding element (14).

7. The stacked circularly polarized antenna structure of claim 1, wherein the first base body (11) has the through holes including a first through hole (113), a second through hole (115), a third through hole (114) and a fourth through hole (116).

8. The stacked circularly polarized antenna structure of claim 7, wherein the first antenna (1) has two first feeding elements (14, 14'), in which the first feeding element (14) goes through the first through hole (113) and the first feeding element (14') goes through the second through hole (115) to electrically connect to the first electrode layer (12), the two first feeding elements (14, 14') extend to outside of the first rear surface (112) of the first base body (11) with their ends, and not to electrically connect the first grounding layer (13).

9. The stacked circularly polarized antenna structure of claim 8, wherein the second base body (21) has the perforations including a first perforation (213) and a second perforation (214).

10. The stacked circularly polarized antenna structure of claim 9, wherein the second antenna (2) has two second feeding elements (24, 24'), in which the second feeding element (24) goes through the first perforation (213) and the second feeding element (24') goes through the second perforation (214) to electrically connect to the second electrode layer (22), and the second feeding element (24) goes through the third through hole (114) of the first base body (11) and the second feeding element (24') goes through the fourth through hole (116) of the first base body (11), the two second feeding elements (24, 24') extend to outside of the first rear surface (112) of the first base body (11) with their ends, and not to electrically connect the first grounding layer (13).

11. The stacked circularly polarized antenna structure of claim 10, wherein the two first feeding elements (14, 14') are nails with T shape sectional view, and each has a head (141) and a rod body (142) extended from the bottom of the head (141), the rod bodies (142, 142) of the first feeding elements (14, 14') go through the first through hole (113) and the second through hole (115) so that the heads (141, 141) electrically connect to the first electrode layer (12); and the second feeding elements (24, 24') are nails with T shape sectional view, and each has a head (241) and a rod body (242) extended from the bottom of the head (241), the rod bodies (242, 242) of the second feeding elements (24, 24') go through the first perforation (213) and the second perforation (214) so that the heads (241, 241) electrically connect to the second electrode layer (22).

12. The stacked circularly polarized antenna structure of claim 11, wherein the first base body (11) and the second base body (21) are square base bodies made of ceramic material, have the same dielectric constant and thickness, and the second base body (21) has the second rear surface (212) with an area smaller than an area of the first electrode layer (12).

13. The stacked circularly polarized antenna structure of claim 12, wherein the adhesive element (3) is a double-sided adhesive.

14. The stacked circularly polarized antenna structure of claim 12, wherein the second rear surface (212) of the second base body (21) is provided with a second grounding layer (23), and the second grounding layer (23) fails to connect electrically to the two second feeding elements (24, 24') and fails to contact electrically the two first feeding elements (14, 14').

* * * * *